US010694841B2

(12) United States Patent
Zhu

(10) Patent No.: US 10,694,841 B2
(45) Date of Patent: Jun. 30, 2020

(54) LIFTING DESK

(71) Applicant: SHENZHEN MINICUTE TECHNOLOGY CO. LTD., Shenzhen (CN)

(72) Inventor: Wenbin Zhu, Shenzhen (CN)

(73) Assignee: Shenzhen Minicute Technology Co. Ltd., Shenzhen (CN)

( * ) Notice: Subject to any disclaimer, the term of this patent is extended or adjusted under 35 U.S.C. 154(b) by 0 days.

(21) Appl. No.: 16/343,712

(22) PCT Filed: Feb. 21, 2017

(86) PCT No.: PCT/CN2017/074264

§ 371 (c)(1),
(2) Date: Apr. 19, 2019

(87) PCT Pub. No.: WO2018/072365

PCT Pub. Date: Apr. 26, 2018

(65) Prior Publication Data

US 2019/0269237 A1 Sep. 5, 2019

(30) Foreign Application Priority Data

Oct. 21, 2016 (CN) ..... 2016 2 1147276 U

(51) Int. Cl.
*A47B 9/16* (2006.01)
*A47B 9/02* (2006.01)

(52) U.S. Cl.
CPC ..... *A47B 9/16* (2013.01); *A47B 9/02* (2013.01); *A47B 2200/0064* (2013.01)

(58) Field of Classification Search
CPC .... A47B 9/16; A47B 9/02; A47B 9/14; A47B 17/02; A47B 21/02
(Continued)

(56) References Cited

U.S. PATENT DOCUMENTS 1,318,564 A * 10/1919 Jenkins ..... A47B 9/00 108/145
4,640,488 A * 2/1987 Sakamoto ..... B60N 2/502 108/145
(Continued)

FOREIGN PATENT DOCUMENTS

CN 204949970 U 1/2016
CN 105342138 A 2/2016
(Continued)

OTHER PUBLICATIONS

International Search Report, PCT/CN2017/074264, dated Apr. 10, 2017, 2 pages.
(Continued)

*Primary Examiner* — Jose V Chen
(74) *Attorney, Agent, or Firm* — Stinson LLP

(57) ABSTRACT

Disclosed is a lifting desk, comprising a desk support (2), a desk top (1) arranged above the desk support (2), and two X-shaped lifting supports (3) arranged on two sides of the desk support (2). Each of the X-shaped lifting supports (3) comprises a first supporting portion (31) and a second supporting portion (32). A tension spring (7) is arranged between an upper end of the first supporting portion (31) and an upper end of the second supporting portion (32), wherein a movable end of the tension spring (7) is connected to the upper end of the first supporting portion (31), and a fixed end of the tension spring (7) is fixed to the desk support (2) via a distance-adjusting device. The distance between the fixed end of the tension spring (7) and the desk support (2) is adjusted using the distance-adjusting device, and the pull force stroke length of the tension spring (7) is changed, so that the pull force of the tension spring (7) is adapted to a load, thereby making the lifting process of the lifting desk
(Continued)

stable and reducing the effort needed therefor, and improving the user experience.

11 Claims, 10 Drawing Sheets

(58) Field of Classification Search
USPC ..... 108/145; 254/122
See application file for complete search history.

(56) References Cited

U.S. PATENT DOCUMENTS

| | | | | |
|---|---|---|---|---|
| 5,649,493 | A * | 7/1997 | Blume | A47B 9/00 108/136 |
| 6,038,986 | A * | 3/2000 | Ransil | A47B 9/02 108/145 |
| 7,246,784 | B1 * | 7/2007 | Lopez | A47B 51/00 108/145 |
| 7,950,338 | B2 * | 5/2011 | Smed | A47B 9/16 108/119 |
| 8,544,391 | B2 * | 10/2013 | Knox | B60N 3/063 108/12 |
| 9,504,316 | B1 * | 11/2016 | Streicher | A47B 21/02 |
| 9,615,655 | B1 * | 4/2017 | Huang | A47B 9/16 |
| 9,681,746 | B1 * | 6/2017 | Chen | A47B 9/02 |
| 10,258,148 | B1 * | 4/2019 | Donner | A47B 21/02 |
| 10,306,977 | B2 * | 6/2019 | Wong | A47B 9/16 |
| 2015/0289641 | A1 * | 10/2015 | Ergun | A47B 9/16 108/42 |
| 2016/0249737 | A1 * | 9/2016 | Han | A47B 9/02 108/145 |
| 2016/0338486 | A1 * | 11/2016 | Martin | A47B 9/16 |
| 2018/0103752 | A1 * | 4/2018 | Zhong | A47B 3/02 |
| 2018/0125227 | A1 * | 5/2018 | Xiang | A47B 21/02 |
| 2018/0184797 | A1 * | 7/2018 | Chuang | A47B 9/16 |
| 2018/0192769 | A1 * | 7/2018 | Xiang | A47B 21/0314 |

FOREIGN PATENT DOCUMENTS

| | | | |
|---|---|---|---|
| CN | 205250723 | U | 5/2016 |
| CN | 105901924 | A | 8/2016 |
| CN | 106263516 | A | 1/2017 |
| JP | H08126528 | A | 5/1996 |

OTHER PUBLICATIONS

Written Opinion, PCT/CN2017/074264, dated Apr. 10, 2017, 5 pages.

* cited by examiner

LIFTING DESK

CROSS-REFERENCE TO RELATED APPLICATIONS

This application is a national stage application of PCT/CN2017/074264, filed Feb. 21, 2017, which claims the benefit of China Patent Application No. 201621147276.3, filed Oct. 21, 2016, the contents of which are incorporated by reference in their entirety for all purposes.

FIELD OF INVENTION

The present invention relates to the technical field of office and study furniture, and particularly relates to a lifting desk.

BACKGROUND OF THE INVENTION

With the popularity and development of computer technology, more and more people work or study through computers. Computers bring convenience to people's work and life, but also bring some negative effects to people. People start to use computers for a long time and sit in front of the computers for a long time, leading to frequent occurrence of occupational diseases such as cervical spondylosis and lumbar spondylosis. More and more people have put forward the concept of healthy office and study.

Studies have shown that if people sit and stand alternately to work, modern occupational diseases such as cervical spondylosis and lumbar spondylosis can be well prevented. Thus, lifting desks have emerged on the market to meet the needs of people sitting and standing alternately to work. However, these products generally have a complicated structure and involve high cost, and the existing enterprises need to eliminate the existing desks and replace them with the lifting desks, which not only wastes time and manpower, but also causes a big cost waste.

On this basis, a lifting desk has appeared on the market. The lifting desk can be used only if placed above the existing desk or above other support. Related office products such as a computer are placed on the lifting desk. When the sitting and standing postures are alternated for work, the height of the lifting desk is adjusted to adapt to the changes in human postures.

On the present market, the power components used in the lifting desk are almost gas springs or tension springs or other accessories, the magnitude of the lifting power of which is fixed and unadjustable, and they can only meet a fixed load range during design. For example, a lifting desk using gas springs as power components can automatically rise at a uniform speed within a designed load range by toggling a switch. However, when the load exceeds the design range, the lifting desk rises insufficiently and needs to be raised manually, so that the user experience is poor. The lifting desk using tension springs as power components rises automatically and quickly by toggling the switch when the desk load is insufficient, so that articles on a desk top fall and the desk is unsafe to be use. When the desk load is too heavy, the desk needs to be raised by a user, so that the user experience is poor.

SUMMARY OF THE INVENTION

(1) Technical Problem

The present invention is directed to provide a lifting desk of which lifting power is adjustable, so that a user can adjust the lifting power according to a load of the lifting desk, and the problems of instable lifting and laborious lifting of the existing lifting desk due to different desk loads are solved.

(2) Technical Solution

In order to solve the above technical problems, the present invention provides a lifting desk, comprising a desk support, a desk top arranged above the desk support, and two X-shaped lifting supports arranged on two sides of the desk support, a leg being arranged on a lower side of each of the X-shaped lifting supports, wherein each of the X-shaped lifting supports comprises a first supporting portion and a second supporting portion, middle parts of the first supporting portion and the second supporting portion are articulated, an upper end of the first supporting portion is slidably connected to the desk support and a lower end of the first supporting portion is articulated to the leg, an upper end of the second supporting portion is articulated to the desk support and a lower end of the second supporting portion is slidably connected to the leg;

a tension spring is arranged between the upper end of the first supporting portion and the upper end of the second supporting portion, a movable end of the tension spring is connected to the upper end of the first supporting portion, and a fixed end of the tension spring is fixed to the desk support via a distance adjusting device for adjusting the distance between the fixed end of the tension spring and the desk support.

Further, each of the distance adjusting devices comprises a tension spring fixing member and an adjusting screw, one end of the adjusting screw passing through the desk support and then being in threaded connection with the tension spring fixing member.

Further, each of the tension spring fixing members is provided with at least two first bending portions for clamping the tension spring, and the two first bending portions are arranged oppositely.

Further, a first torsion spring is arranged at a position where the first supporting portion is articulated to the leg, the first torsion spring is sleeved on a first articulated shaft, one end of the first torsion spring is provided with a second bending portion and the other end of the first torsion spring abuts against a torsion spring baffle; when the lifting desk is lowered, the first supporting portion is rotated, and the lower end thereof abuts against the second bending portion and pushes the first torsion spring to rotate.

Further, an adjusting knob is arranged in the leg, the adjusting knob comprises a dial, a plurality of supporting platforms sequentially increasing in height are arranged above the dial, and the dial is partially exposed out of the leg;

When the lifting desk is lowered, the first supporting portion is rotated, and one end of the first torsion spring rotates with the lower end of the first supporting portion via the second bending portion, so that the other end of the first torsion spring gradually abuts against one of the supporting platforms.

Further, the upper end of the first supporting portion is slidably connected to the desk support via a first slider, the lower end of the second supporting portion is slidably connected to the desk support via a second slider, the upper end of the first supporting portion is articulated with the first slider, and the lower end of the second supporting portion is articulated with the second slider.

Further, the desk support is provided with a plurality of limiting holes at intervals;

Further, the lifting desk further comprises a locking device connected to the first slider, wherein the locking device comprises:

a handle, being articulated to the desk support by a second articulated shaft, the second articulated shaft being sleeved with a second torsion spring for providing a restoring force for the handle;

a latch box, being fixed to the first slider;

a latch, being sleeved with a spring baffle and arranged in the latch box, one end of the latch passing through the latch box and the first slider in sequence and then being inserted into the limiting hole;

a spring, being sleeved on the latch, one end of the spring abutting against the spring baffle and moving together with the spring baffle to provide a restoring force for the latch; and a pull wire, one end of the pull wire being connected to the handle, and the other end of the pull wire being connected to the latch to pull the latch out of the limiting hole.

Further, the lower ends of the first supporting portion and the second supporting portion are bent toward a side close to each other.

Further, the desk support is provided with a stop block, and the tension spring fixing member at least partially abuts against the stop block to limit initial position of the tension spring.

Further, the desk support is provided with an observation hole capable of displaying the tension spring fixing member, gear marks are provided around the observation hole, and the gear marks corresponding to the edge of the tension spring fixing member represent the current gear.

(3) Advantageous Effect

The above technical solution of the present invention has the following advantages: the lifting desk provided by the present invention is provided with a distance adjusting device at the fixed end of the tension spring of each X-shaped support, and when the load on the desk changes, the distance adjusting device is used to adjust the distance between the fixed end of the tension spring and the desk support to change the pull force stroke length of the tension spring, so that the pull force of the tension spring is adapted to the load, the lifting process of the lifting desk is stable and labor-saving, and the user experience is improved.

Figure 1:
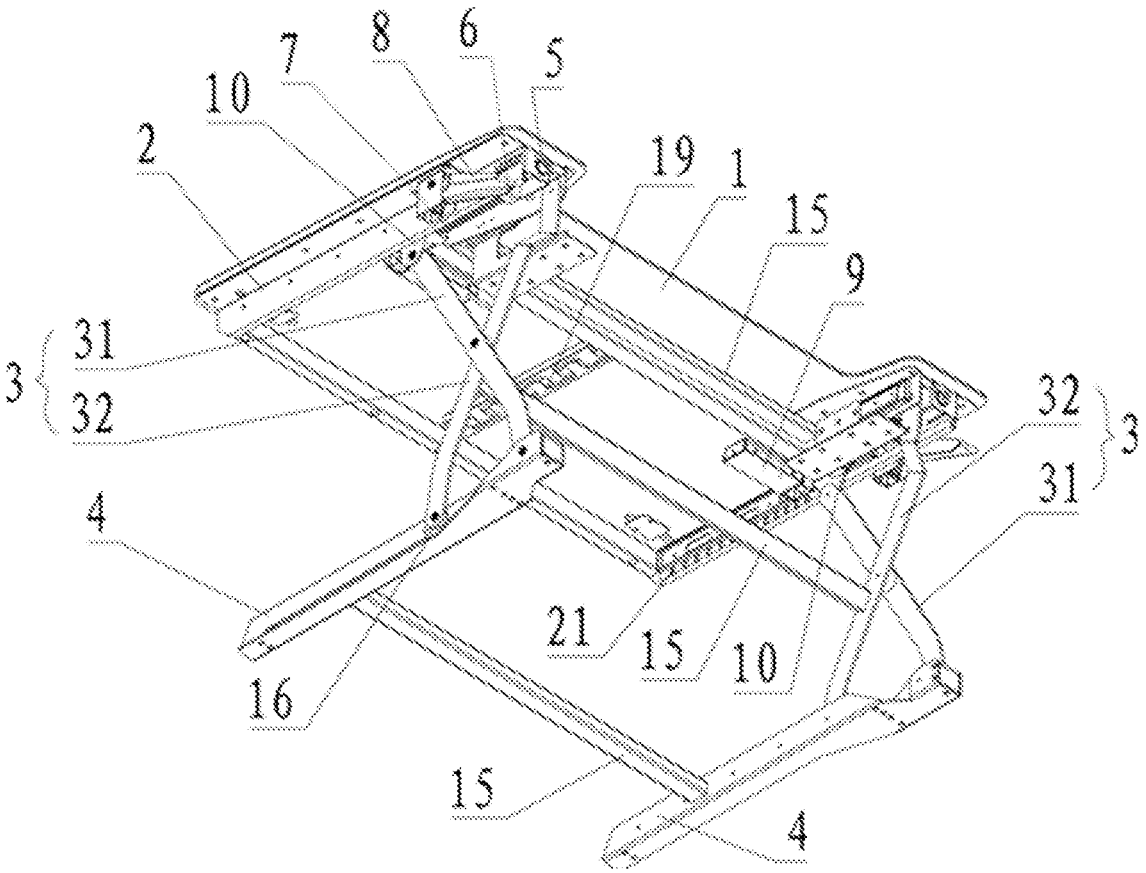
FIG. 1 is a structural schematic view of a lifting desk after a keyboard supporting plate is removed according to Embodiment 1 of the present invention.

In which: 1: desk top; 2: desk support; 21: limiting hole; 22: observation hole; 3: X-shaped lifting support; 31: first supporting portion; 32: second supporting portion; 4: leg; 5: adjusting screw; 6: tension spring fixing member; 61: first bending portion; 7: tension spring; 8: handle; 9: latch box; 10: first slider; 11: first articulated shaft; 12: first torsion spring; 121: second bending portion; 13: spring; 14: spring baffle; 15: connecting rod; 16: second slider; 17: latch; 18: stop block; 19: wire collection trough; 20: adjusting knob; 201: dial; 202: supporting platform; 203: transition surface.

DETAILED DESCRIPTION OF THE EMBODIMENTS

In order to make the objectives, technical solutions and advantages of the present invention clearer, the following clearly and completely describes the technical solutions in the embodiments of the present invention with reference to the accompanying drawings in the embodiments of the present invention. Apparently, the described embodiments are only part of the embodiments of the present invention, not all of them. All other embodiments obtained by those of ordinary skill in the art based on the embodiments of the present invention without any creative effort shall fall into the protection scope of the present invention.

In the description of the present invention, it should be noted that the terms "upper", "lower", "front", "rear", "left", "right", "top", "bottom", "inner", "outer" and the like indicate the orientations or positional relationships based on the orientations or positional relationships shown in the drawings. The terms are only for description convenience of the present invention and simplification of the description, but do not indicate or imply that the referred devices or elements must have specific orientations or be constructed and operated in specific orientations. Therefore, the terms should not be understood to limit the present invention.

Furthermore, the terms "first" and "second" are only for the sake of description, and cannot be understood as indicating or implying the relative importance.

Embodiment 1

As shown in FIG. 1, a lifting desk provided by the embodiment of the present invention includes a desk top 1, a desk support 2, two X-shaped lifting supports 3, and two legs 4, wherein the desk top 1 is arranged above the desk support 2, the two X-shaped lifting supports 3 are arranged on two sides of the desk support 2 respectively, and a leg 4 is arranged on each lower side of the desk support 2. Specifically, each X-shaped lifting support 3 includes a first supporting portion 31 and a second supporting portion 32, middle parts of the first supporting portion 31 and the second supporting portion 32 are articulated, an upper end of the first supporting portion 31 is slidably connected to the desk support 2 and a lower end thereof is articulated to the leg 4, an upper end of the second supporting portion 32 is articulated to the desk support 2 and a lower end thereof is slidably connected to the leg 4, and the height of the desk top 1 is adjusted by adjusting the distance between the ends of the first supporting portion 31 and the second supporting portion 32.

Figure 2:
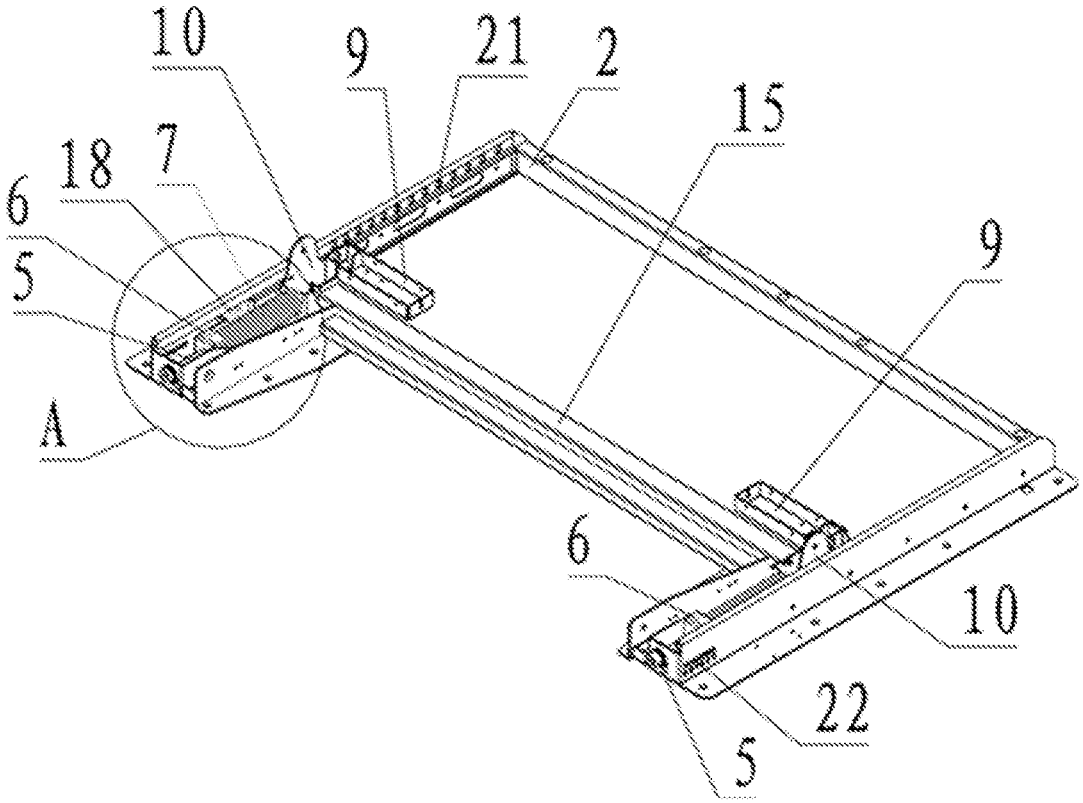
FIG. 2 is a structural schematic view of the desk support according to Embodiment 1 of the present invention.

Specifically, as shown in FIG. 1 and FIG. 2, the upper end of the first supporting portion 31 is slidably connected to the desk support 2 via a first slider 10, the lower end of the second supporting portion 21 is slidably connected to the desk support 2 via a second slider 16, the upper end of the first supporting portion is articulated with the first slider, and the lower end of the second supporting portion is articulated with the second slider. More specifically, the first slider 10 is connected to a first slide rail arranged on the desk support 2, and the second slider 16 is connected to a second slide rail arranged within the leg 4.

Figure 3:
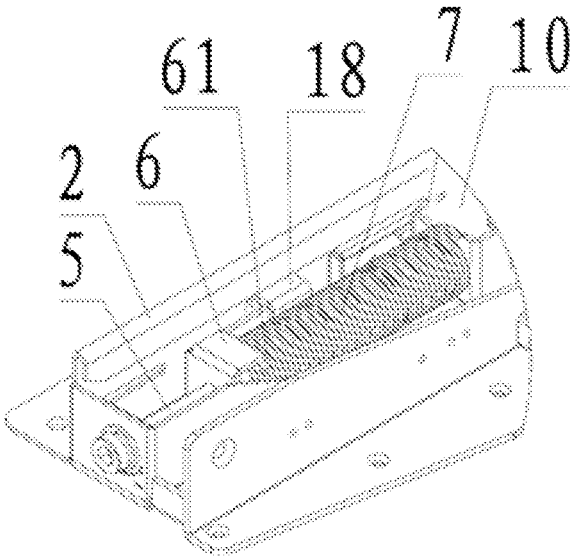
FIG. 3 is an enlarged schematic view of part A in FIG. 2.

Further, as shown in FIGS. 1-3, a tension spring 7 is arranged between the upper end of the first supporting portion 31 and the upper end of the second supporting portion 32 one end of the tension spring 7 is connected to the upper end of the first supporting portion 31, and the other end is fixed to the desk support 2 by a distance adjusting device. During the lifting process of the lifting desk, the end connected to the upper end of the first supporting portion 31 is a movable end, which can synchronously move with the upper end of the first supporting portion 31, and the other end opposite to the movable end is a fixed end. According to the difference of a load on the desk, the distance between the fixed end and the end of the desk support 2 is adjusted using the distance adjusting device, and the pull force stroke initial length of the tension spring 7 is changed, so that the pull force of the tension spring 7 is adapted to the load, the lifting process of the lifting desk is stable and labor-saving, and the user experience is improved.

Specifically, if the fixed end of the tension spring 7 is closer to the desk support, the pull force is larger, and the bearable load is larger; on the contrary, the load that the tension spring 7 can bear is smaller.

Preferably, the distance adjusting device includes a tension spring fixing member 6 and an adjusting screw 5, wherein one end of the adjusting screw 5 passes through the desk support 2 and then is in threaded connection with the tension spring fixing member 6, and the other end is located outside the desk support 2 to facilitate adjustment.

More specifically, the tension spring fixing member 6 is a sheet metal member provided with a through hole in the sheet metal wall, and a nut matching the adjusting screw 5 is coaxially arranged on one side or two sides of the through hole.

Preferably, a retaining ring is arranged at an end of the adjusting screw 5 away from the desk support 2 to prevent the adjusting screw 5 from coming off.

Further, the tension spring fixing member 6 is provided with at least two first bending portions 61 for clamping the tension spring 7, and preferably, the two first bending portions 61 are arranged oppositely, that is, the two first bending portions 61 are bent toward a side close to each other, and the opposite two first bending portions 61 are inserted from two opposite sides of the tension spring 7 and clamped during installation, so that the tension spring 7 maintains the tension balance.

Further, as shown in FIG. 2 and FIG. 3, the desk support 2 is provided with a stop block 18, and the tension spring fixing members 6 at least partially abut against the stop block 18. When the lifting desk leaves the factory, the tension spring fixing members 6 abut against the stop block 18, and the position of the tension spring are the initial position of the tension springs 7, which is adapted to the lifting and lowering of the desk top when the load is small.

Figure 4:
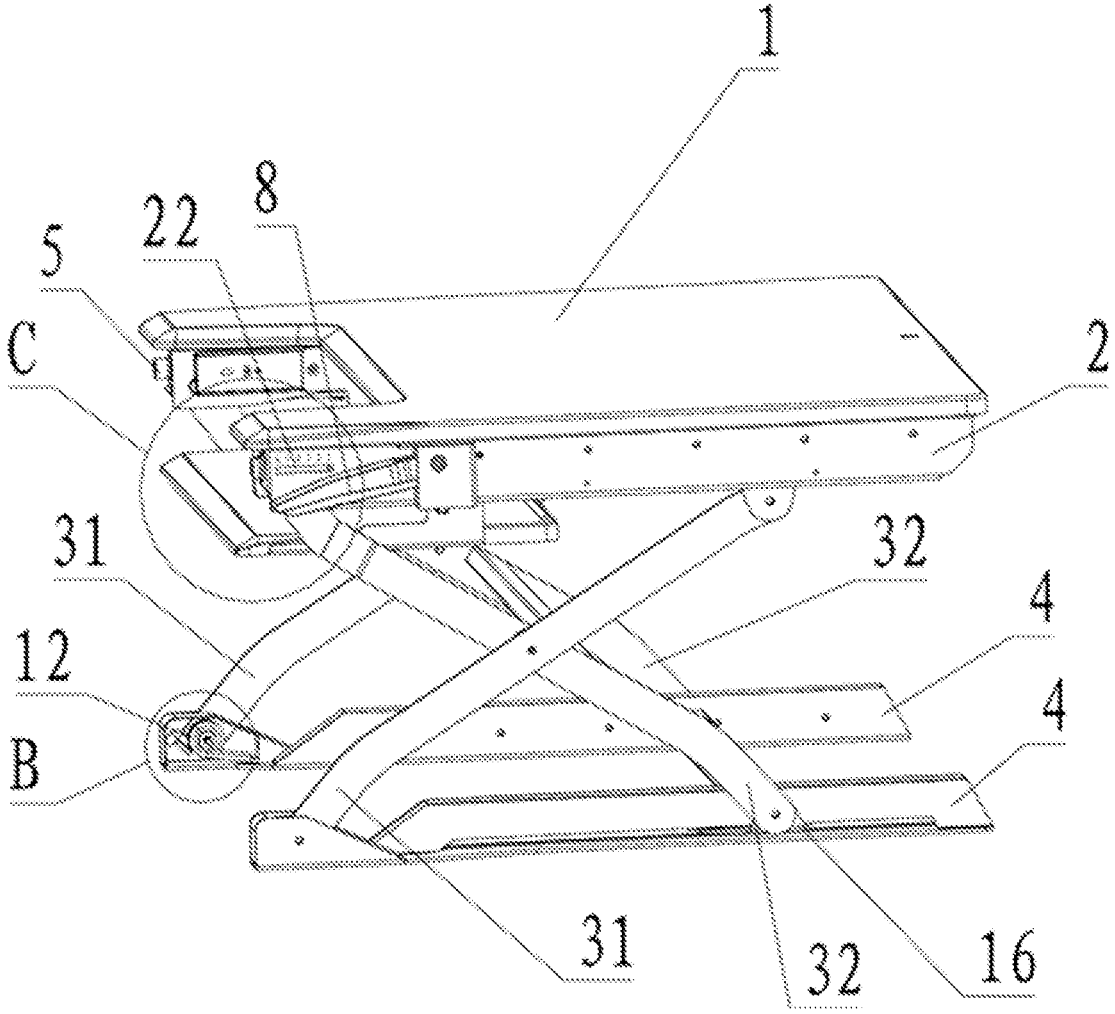
FIG. 4 is a structural schematic view of the lifting desk viewed from another angle according to Embodiment 1 of the present invention.
Figure 6:
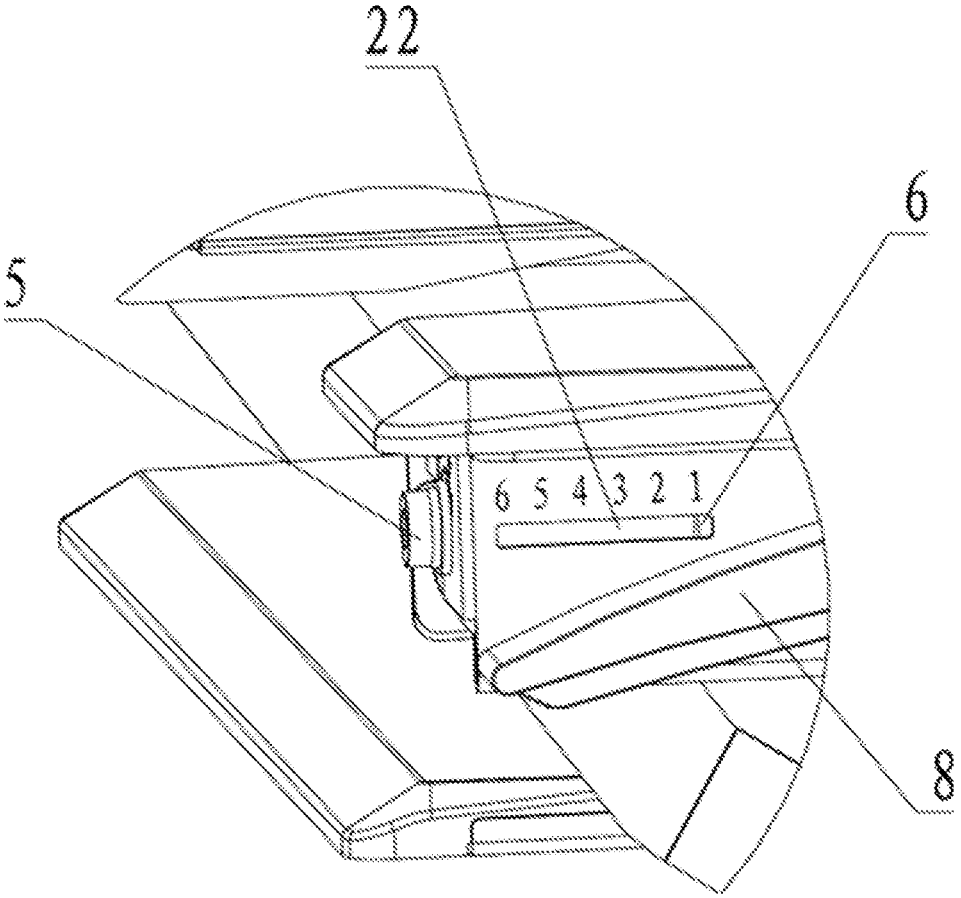
FIG. 6 is an enlarged schematic view of part C in FIG. 4.

In order to ensure the lifting force on two sides of the lifting desk is same and facilitate user's adjustment, preferably, as shown in FIGS. 4 and 6, the desk support 2 is provided with an observation hole 22, and gear marks are provided around the observation hole 22. When the tension springs 7 are in the initial state, the edge of the tension spring fixing members 6 can be seen from the observation hole 22, and the edge of the tension spring fixing members 6 corresponds to the lowest gear (the pulling stroke of the tension springs 7 is shortest).

In order to clearly see the current positions of the tension springs 7, the tension spring fixing members 6 are preferably colored, for example, green. In the initial state of the tension springs 7, only a green strip can be seen from the observation hole 22. As the tension spring fixing members 6 move, the green strip gradually fill the whole observation hole 22, and the foremost end of the green strip (the front end in the moving direction of the green strip) corresponds to the current gear.

The gear marks may be digital scales, patterns or texts, for example, digital scale logos; patterns of a tablet computer, a notebook computer, a desktop computer, etc., or patterns of color changes of different shades which represent different weights; or text prompts.

Figure 5:
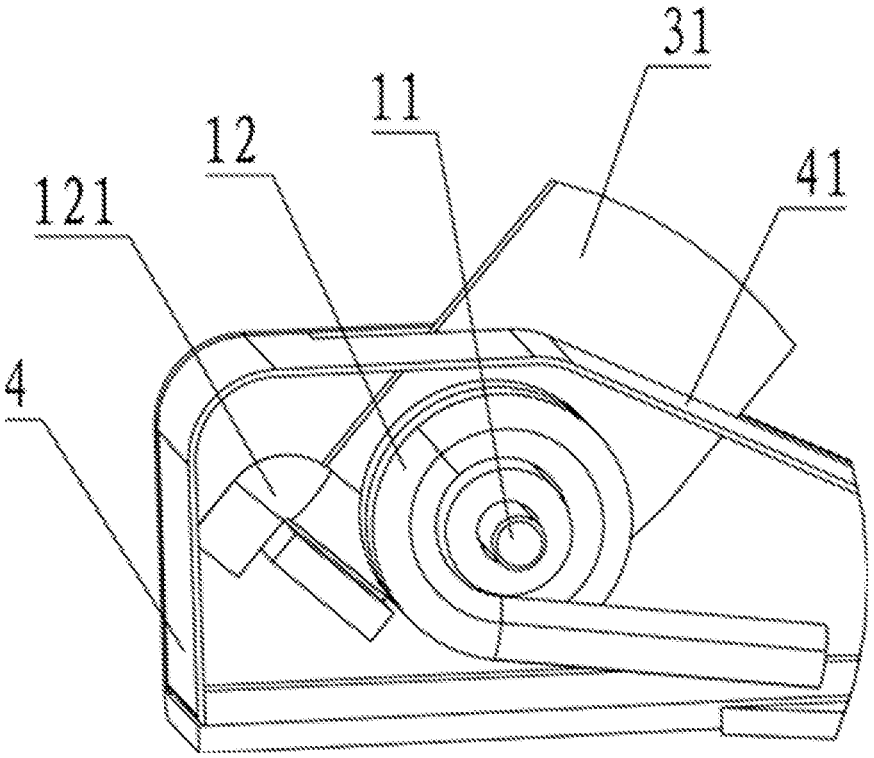
FIG. 5 is an enlarged schematic view of part B in FIG. 4.

During the lowering process of the lifting desk, the pull force of the tension spring 7 gradually increases. When the lifting desk is lowered to a critical point, the balance of the force suddenly breaks. At this time, the tension spring 7 substantially loses the function as a buffer during lowering, and the desk top suddenly drops. In the lifting process of the lifting desk, the initial pull force may be insufficient, and the lifting is more laborious. In order to overcome the problems, further, as shown in FIG. 4 and FIG. 5, a first torsion spring 12 is arranged at a position where the first supporting portion 31 is articulated to the leg 4. Specifically, the first torsion spring 12 is sleeved on a first articulated shaft 11 (an articulated shaft for the first supporting portion 31 and the leg 4), one end of the first torsion spring 12 is provided with a second bending portion 121 and the other end abuts against a torsion spring baffle 41, and the torsion spring baffle 41 and the leg 4 form a relatively closed space. When the desk top 1 is lifted to the highest, the second bending portion 121 is apart away from the lower end of the first supporting portion 31 at a certain distance. When the desk top 1 is lowered, the lower end of the first supporting portion 31 is rotated clockwise. When the desk top is lowered to the critical point, the lower end of the first supporting portion 31 abuts against the second bending portion 121, and pushes the first torsion spring 12 to rotate, so that the lowering of the desk top 1 is buffered. When the desk top 1 is lifted, the lower end of the first supporting portion 31 is rotated counterclockwise, the first torsion spring 12 is restored, and then a thrust is applied to the lower end of the first supporting portion 31 to assist the desk top 1 in lifting, so that the early lifting period of the desk top 1 is also labor-saving.

Preferably, the lower end of the first supporting portion is provided with a bend or a stopper matching with the second bending portion 121 to push the first torsion spring 12 to rotate.

When the lifting desk is used, it is lifted and lowered not only to the highest and lowest positions, but also to other different heights according to different users. To achieve the purpose, as shown in FIG. 7 and FIG. 8, the desk support 2 of the lifting desk in one embodiment is further provided with a plurality of limiting holes 22, the lifting desk further comprises a locking device matching the limiting holes 21 for locking the lifting desk to a certain height, and the locking device is connected to the first slider 10.

Specifically, the locking device includes a handle 8, a pull wire (not shown), a latch box 9, a latch 17, and a spring baffle 14 sleeved outside the latch 17, wherein the handle 8 is articulated to the desk support 2 by a second articulated shaft, a second torsion spring is sleeved outside the second articulated shaft, one end of the second torsion spring abuts against the desk support 2, and the other end abuts against the handle 8 for providing a restoring force for the handle; the latch box 9 is fixed to the first slider 10, and can move together with the first slider 10; the latch 17 is arranged in the latch box 9, and one end of the latch 17 passes through the latch box 9 and the first slider 10 sequentially and then is inserted into the limiting hole 21; a spring 13 is sleeved on the latch 17, one end of the spring 13 abuts against the spring baffle 14 and can move together with the spring baffle 14, and the other end of the spring 14 is fixed; one end of the pull wire is connected with the handle 8, and the other end is connected to the latch 17 for pulling the latch 17 out of the limiting hole 21; when the latch 17 is pulled out, the spring baffle 14 moves together with the latch 17, and the spring 13 is compressed; and when the pull force of the latch 17 disappears, the spring 13 provides a restoring force for the latch 17.

In order to further reduce the sliding strokes of the first supporting portion 31 and the second supporting portion 32 when the lifting height of the desk top is constant, preferably, as shown in FIG. 4, the lower ends of the first supporting portion 31 and the second supporting portion 32 are bent toward a side close to each other.

Figure 7:
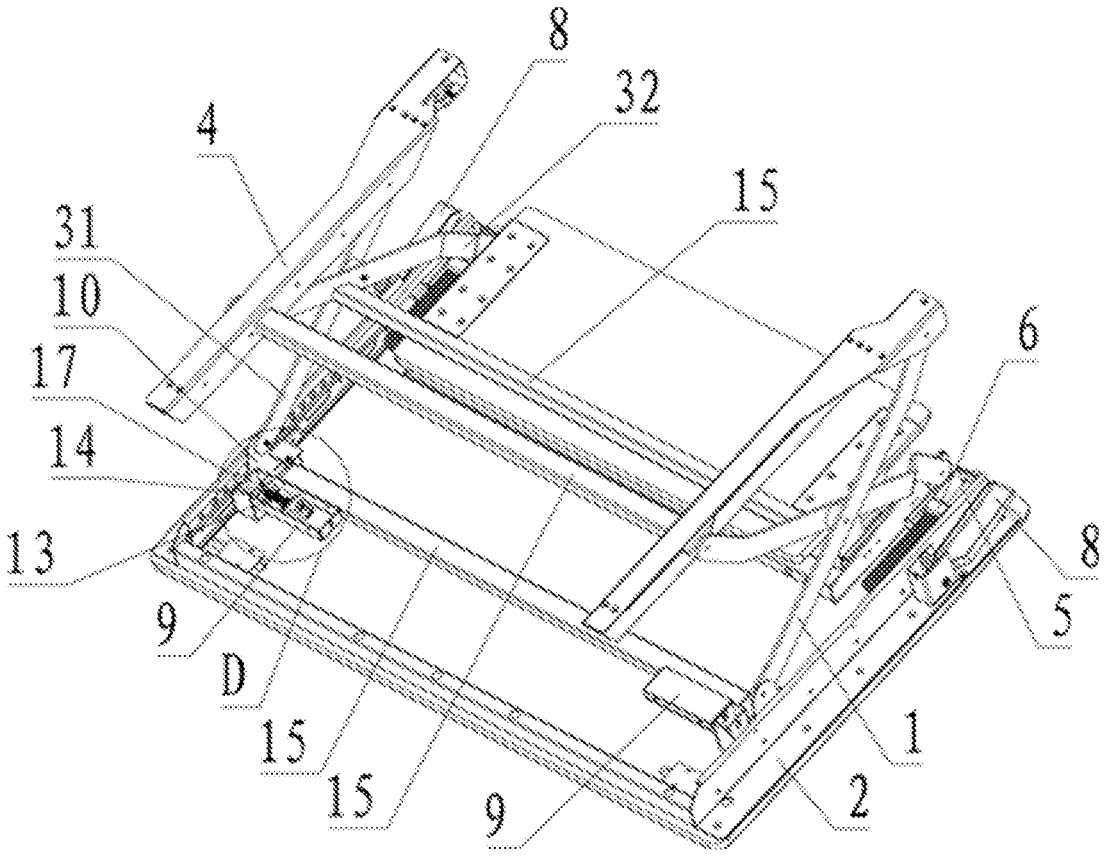
FIG. 7 is a structural schematic view of the lifting desk viewed from a further angle according to Embodiment 1 of the present invention.
Figure 8:
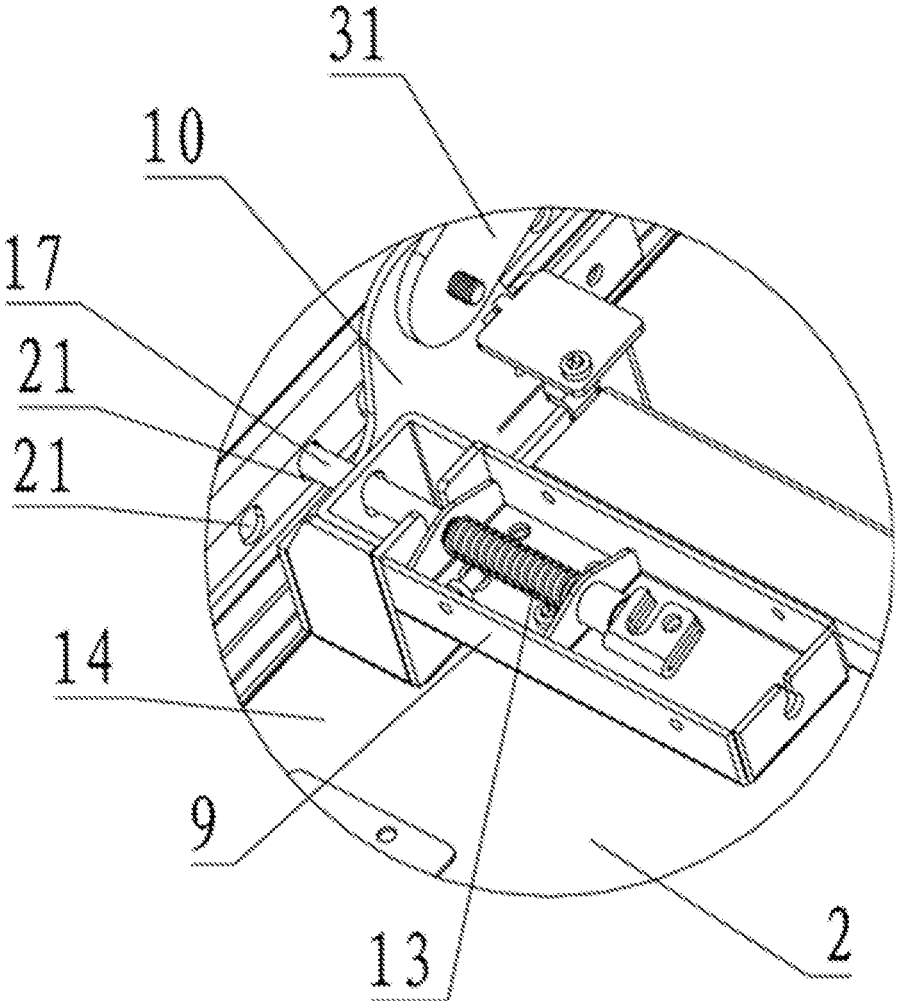
FIG. 8 is an enlarged schematic view of part D in FIG. 7.

In order to increase the structural strength of the lifting desk, preferably, as shown in FIGS. 1 and 7, the X-shaped lifting support 3 is connected by a connecting rod 15, and more preferably, two ends of the connecting rod 15 are respectively fixed nearby middle parts of the second supporting portions 32.

Further, the two legs 4 are connected by a connecting rod 15 to increase the structural strength.

Further, the two first sliders 10 are connected by a connecting rod 15, which not only increases the structural strength of the lifting desk, but also enables the two first sliders 10 to slide synchronously to prevent the desk top 1 from tilting.

In order to collect cables such as a power line and a data wire together, as shown in FIG. 1, a wire collection trough 19 is arranged at the bottom of the desk top, and the wire collection trough 19 is of a split structure and includes a first trough body and a second trough body, wherein each of the first trough body and the second trough body is provided with a plurality of protruding portions at intervals.

Specifically, the first trough body and the second trough body are fixedly mounted at the bottom of the desk top 1 at a suitable distance, the protruding portions of the two trough bodies are staggered, that is, a protruding portion of one trough body extends between two adjacent protruding portions of the other trough body, a distance of at least one power line is reserved between the front end of the protruding portion and the other trough body, and a distance of at least one cable is reserved between the protruding portion extending between the two adjacent protruding portions of the other trough body and the two adjacent protruding portions, so that a sinuous communicating wire passage is formed between the first trough body and the second trough body. The cables such as a power line and a data wire can be directly wound into the wire collection trough 19 in use without considering the plug of the power line, so convenience is brought to the use.

When the pull force of the tension springs 7 needs to be adjusted, the distances between the tension spring fixing members 6 and the desk support 2 are adjusted, so that the tension springs 7 have the pull force adapted to a load. The distances between the tension spring fixing members 6 on two sides and the desk support 2 should be identical during adjustment. After the adjustment, the handle 8 is released, and the latche 17 is inserted into the limiting hole 21 to lock the current height of the lifting desk.

Preferably, the lifting desk is first lifted to the highest position, and then the distances between the fixed ends of the tension springs 7 and the desk support 2 are adjusted, because when the lifting desk is at the highest position, the tension springs 7 are not pulled open and bear a smaller force, which facilitates the adjustment of the screws.

Embodiment 2

Figure 9:
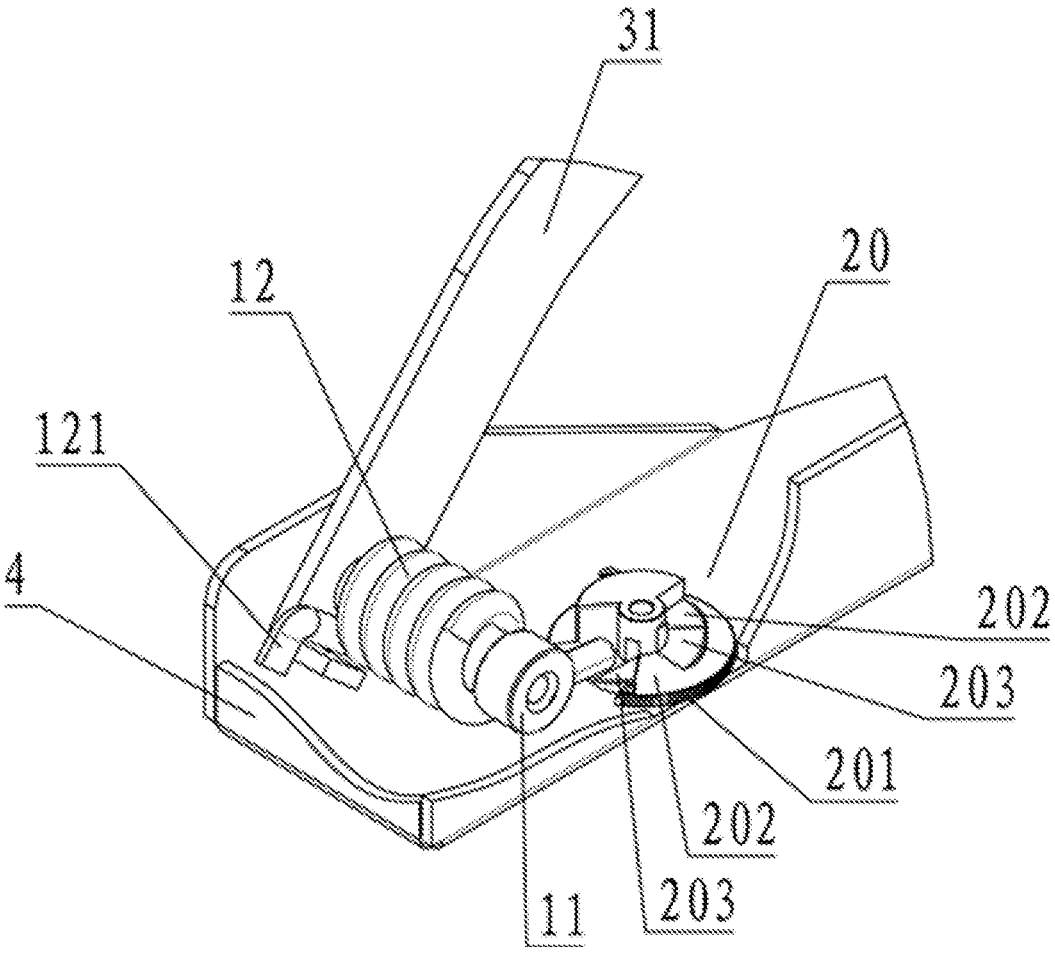
FIG. 9 is a structural schematic view of an adjusting knob according to Embodiment 2 of the present invention.
Figure 10:
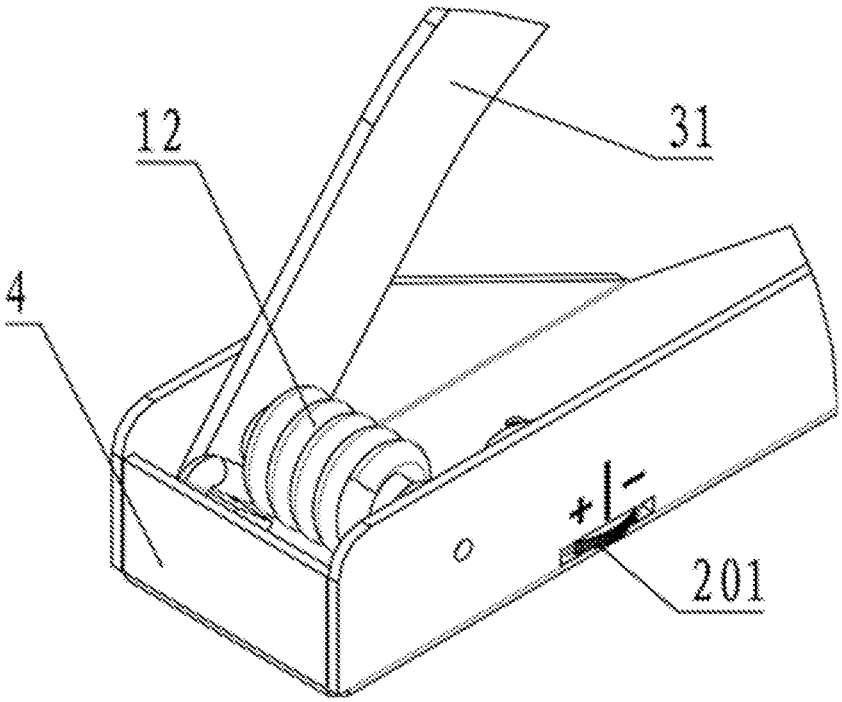
FIG. 10 is a partial structural view of a leg according to Embodiment 2 of the present invention.

As shown in FIG. 9 and FIG. 10, Embodiment 2 is substantially the same as Embodiment 1, and the same part would not be described again. The difference lies in that an adjusting knob 20 for adjusting the torsion of the first torsion spring 12 is arranged in the leg 4. Specifically, the adjusting knob 20 includes a dial 201, and a plurality of supporting platforms 202 sequentially increasing in height are arranged above the dial 201, that is, the plurality of supporting platforms 202 are sequentially arranged in a direction from low to high. The dial 201 is partially exposed out of the leg 4 to facilitate the adjustment of the torsion of the first torsion spring 12 via the dial 201. When the load on the desk increases, the dial 201 may be dialled, so that the supporting platform 202 at the corresponding height is located below the end of the first torsion spring 12. When the lifting desk is lowered, the first supporting portion 31 is rotated clockwise. When the rotation reaches a certain degree, one end of the first torsion spring 12 rotates along with the lower end of the first supporting portion 31 via the second bending portion 121, and abuts against the supporting platform 202 on the lower side. The torsion of the first torsion spring 12 is adjusted by means of the supporting platforms 202 of different heights.

Preferably, the gear of the first torsion spring 12 corresponds to the gear of the tension spring 7, for example, the first gear of the tension spring 7 corresponds to the first gear of the first torsion spring 12, and the second gear of the tension spring 7 corresponds to the second gear of the first torsion spring 12. The one-to-one correspondence of the gears facilitates the adjustment. Or the first gear of the first torsion spring 12 corresponds to the first gear and the second gear of the tension spring 7, the second gear of the first torsion spring 12 corresponds to the third gear and the fourth gear of the tension spring 7, and so on, which facilitates the user's adjustment, so that the both can be adapted to the load.

Preferably, the two adjacent supporting platforms 202 are connected by a transition surface 203. Even if the end of the first torsion spring 12 abuts against the supporting platform 202, the gear can also be adjusted.

In the initial state, the adjusting knob 20 is at the lowest gear, that is, the end of the first torsion spring 12 abuts against the lowest supporting platform 202 during rotation, and at this time, the first torsion spring 12 corresponds to the initial position of the tension spring 7. As the desk load increases, the pull force of the tension spring 7 is adjusted by adjusting the distance between the fixed end of the tension spring 7 and the desk support 2, so that early-period lowering and late-period lifting of the lifting desk are kept stable and labor-saving. The torsion of the first torsion spring 12 is adjusted by rotating the adjusting knob 20 to buffer late-period lowering of the lifting desk and provide a lifting assistance for early-period lifting, so that the lifting desk is stable, labor-saving and safe in the process of lowering and lifting.

Finally, it should be noted that the above embodiments are only for explaining, but not limiting, the technical solutions of the present invention; although the present invention has been described in detail with reference to the foregoing embodiments, those of ordinary skill in the art should understood that the technical solutions described in the foregoing embodiments may be modified, or some of the technical features may be equivalently substituted; and such modifications or substitutions do not make the essence of the corresponding technical solutions depart from the spirit and scope of the technical solutions of the present invention.

What is claimed is:

1. A lifting desk, comprising a desk support, a desk top arranged above the desk support, and two X-shaped lifting supports arranged on two sides of the desk support, a leg being arranged on a lower side of each of the X-shaped lifting supports, wherein each of the X-shaped lifting supports comprises a first supporting portion and a second supporting portion, middle parts of the first supporting portion and the second supporting portion are articulated, an upper end of the first supporting portion is slidably connected to the desk support and a lower end of the first supporting portion is articulated to the leg, an upper end of the second supporting portion is articulated to the desk support and a lower end of the second supporting portion is slidably connected to the leg; a tension spring is arranged between the upper end of the first supporting portion and the upper end of the second supporting portion, a movable end of the tension spring is connected to the upper end of the first supporting portion, and a fixed end of the tension spring is fixed to the desk support via a distance adjusting device; each of the distance adjusting devices comprises a tension spring fixing member and an adjusting screw, one end of the adjusting screw passing through the desk support and then being in threaded connection with the tension spring fixing member, and the other end of the adjusting screw is located outside the desk support, wherein the distance adjusting devices adjusting the distance between the fixed end of the tension spring and the desk support via adjusting the adjusting screw that is in threaded connection with the tension spring fixing member;

wherein the upper end of the first supporting portion is slidably connected to the desk support via a first slider, the lower end of the second supporting portion is slidably connected to the desk support via a second slider, the upper end of the first supporting portion is articulated with the first slider, and the lower end of the second supporting portion is articulated with the second slider;

wherein the desk support is provided with a plurality of limiting holes at intervals;

the lifting desk further comprises a locking device connected to the first slider, wherein the locking device comprises:

a handle, being articulated to the desk support by a second articulated shaft, the second articulated shaft being sleeved with a second torsion spring for providing a restoring force for the handle;

a latch box, being fixed to the first slider;

a latch, being sleeved with a spring baffle and arranged in the latch box, one end of the latch passing through the latch box and the first slider in sequence and then being inserted into the limiting hole;

a spring, being sleeved on the latch, one end of the spring abutting against the spring baffle and moving together with the spring baffle to provide a restoring force for the latch; and a pull wire, one end of the pull wire being connected to the handle, and the other end of the pull wire being connected to the latch to pull the latch out of the limiting hole.

2. The lifting desk according to claim 1, wherein each of the tension spring fixing members is provided with at least two first bending portions for clamping the tension spring by inserting the two first bending portions into and from the opposite sides of the tension spring.

3. The lifting desk according to claim 2, wherein the desk support is provided with an observation hole capable of displaying the tension spring fixing member, gear marks are provided around the observation hole, and a gear mark corresponding to the edge of the tension spring fixing member represent the current gear.

4. The lifting desk according to claim 1, wherein a first torsion spring is arranged at a position where the first supporting portion is articulated to the leg, the first torsion spring is sleeved on a first articulated shaft, one end of the first torsion spring is provided with a second bending portion and the other end of the first torsion spring abuts against a torsion spring baffle; when the lifting desk is lowered, the first supporting portion is rotated, and the lower end thereof abuts against the second bending portion and pushes the first torsion spring to rotate.

5. The lifting desk according to claim 4, wherein the desk support is provided with an observation hole capable of displaying the tension spring fixing member, gear marks are provided around the observation hole, and a gear mark corresponding to the edge of the tension spring fixing member represent the current gear.

6. The lifting desk according to claim 4, wherein an adjusting knob is arranged in the leg, the adjusting knob comprises a dial, a plurality of supporting platforms sequentially increasing in height are arranged above the dial, and the dial is partially exposed out of the leg; when the lifting desk is lowered, the first supporting portion is rotated, and one end of the first torsion spring rotates with the lower end of the first supporting portion via the second bending portion, so that the other end of the first torsion spring gradually abuts against one of the supporting platforms.

7. The lifting desk according to claim 6, wherein the desk support is provided with an observation hole capable of displaying the tension spring fixing member, gear marks are provided around the observation hole, and a gear mark corresponding to the edge of the tension spring fixing member represent the current gear.

8. The lifting desk according to claim 1, wherein the lower ends of the first supporting portion and the second supporting portion are bent toward a side close to each other.

9. The lifting desk according to claim 8, wherein the desk support is provided with an observation hole capable of displaying the tension spring fixing member, gear marks are provided around the observation hole, and a gear mark corresponding to the edge of the tension spring fixing member represent the current gear.

10. The lifting desk according to claim 1, wherein the desk support is provided with a stop block, and the tension spring fixing member at least partially abuts against the stop block to limit initial position of the tension spring.

11. The lifting desk according to claim 1, wherein the desk support is provided with an observation hole capable of displaying the tension spring fixing member, gear marks are provided around the observation hole, and a gear mark corresponding to the edge of the tension spring fixing member represent the current gear.

* * * * *